US011168596B2

(12) United States Patent
Aufranc et al.

(10) Patent No.: US 11,168,596 B2
(45) Date of Patent: Nov. 9, 2021

(54) PERFECTED EXHAUST GAS HEATING DEVICE, ESPECIALLY FOR A MOTOR VEHICLE

(71) Applicant: FAURECIA SYSTEMES D'ECHAPPEMENT, Nanterre (FR)

(72) Inventors: Guillaume Aufranc, Courcelles-les-Montbeliard (FR); Xavier Bartolo, Etouvans (FR); Maxime Goncalves, Belfort (FR); Antonin Mathey, Lyoffans (FR); Christophe Tournier, Etouvans (FR)

(73) Assignee: FAURECIA SYSTEMES D'ECHAPPEMENT

( * ) Notice: Subject to any disclaimer, the term of this patent is extended or adjusted under 35 U.S.C. 154(b) by 113 days.

(21) Appl. No.: 16/555,286

(22) Filed: Aug. 29, 2019

(65) Prior Publication Data

US 2020/0072107 A1 Mar. 5, 2020

(30) Foreign Application Priority Data

Sep. 3, 2018 (FR) ..... 18 57895

(51) Int. Cl.

| | |
|---|---|
| ***F01N 3/20*** | (2006.01) |
| ***F02D 41/02*** | (2006.01) |
| ***H05B 3/42*** | (2006.01) |
| ***H05B 3/06*** | (2006.01) |
| ***H05B 1/02*** | (2006.01) |

(52) U.S. Cl.

CPC ..... *F01N 3/2013* (2013.01); *F02D 41/024* (2013.01); *H05B 1/0244* (2013.01); *H05B 3/06* (2013.01); *H05B 3/42* (2013.01)

(58) Field of Classification Search

CPC .... F01N 2240/16; F01N 3/027; F01N 3/2013; H05B 3/06

See application file for complete search history.

(56) References Cited

U.S. PATENT DOCUMENTS

| | | | | |
|---|---|---|---|---|
| 4,671,058 | A * | 6/1987 | Yoshida | F01N 3/027 219/205 |
| 4,723,973 | A * | 2/1988 | Oyobe | F01N 3/027 219/552 |
| 5,101,095 | A * | 3/1992 | Wagner | F01N 3/027 123/549 |
| 5,749,223 | A * | 5/1998 | Kreucher | F01N 3/2013 60/300 |

* cited by examiner

*Primary Examiner* — Anthony Ayala Delgado

(74) *Attorney, Agent, or Firm* — Carlson, Gaskey & Olds, P.C.

(57) ABSTRACT

A heating device includes conductive elements, positive and negative electrical terminals, first and second connecting parts each including a first part that is a substantially planar longitudinal part extending in a longitudinal direction, a second connecting part connected to the first part while extending transversely to this first part, the second part being connected to a respective one of the terminals, and at least one third part, connected to the first part while extending transverse to this first part. Each conductive element has one end connected to the second or third part of one of the first and second connecting pieces, and another end connected to the second or third part of the other first and second connecting piece.

10 Claims, 3 Drawing Sheets

PERFECTED EXHAUST GAS HEATING DEVICE, ESPECIALLY FOR A MOTOR VEHICLE

CROSS-REFERENCE TO RELATED APPLICATIONS

This application is a U.S. non-provisional application claiming the benefit of French Application No. 18 57895, filed Sep. 3, 2018, which is incorporated herein by its entirety.

TECHNICAL FIELD

The present invention relates to an exhaust gas heating device, in particular for a combustion engine. Such a heating device is intended to heat the exhaust gases and a catalyst, in order to optimize the catalytic conversion of the polluting gases, in a moving vehicle, such as an automobile, a truck, a ship, or in a stationary engine, such as a generating set.

More particularly, the invention relates to an exhaust gas heating device, includes at least one conductive element extending between two ends and arranged in a passage for the exhaust gases, each conductive element being connected at each of its ends to a respective electrode.

BACKGROUND

The conductive element is subject to relatively difficult living conditions, since it is located in the exhaust gas passage. More particularly, the conductive element is in particular subject to a high temperature, chemical reactions, impacts with particles, etc.

The invention in particular aims to provide effective fastening of each conductive element, despite these difficult living conditions.

SUMMARY

An exhaust gas heating device, including:

at least one conductive element intended to be arranged in an exhaust gas passage, and molded to heat the exhaust gases circulating in this passage, each conductive element extending in a shared predefined direction between a first and a second end, and a first positive electric terminal and a second negative electric terminal, and first and second connecting pieces made from a conductive material, such that each connecting piece includes:

a first part that is a substantially planar longitudinal part extending in a longitudinal direction, a second part connected to the first part while extending transversely to this first part, the second part being connected to a respective one of the terminals, at least one third part, connected to the first part while extending transversely to this first part, each conductive element having one of its ends connected to the second or third part of one of the connecting pieces, and the other of its ends connected to the second or third part of the other connecting piece.

The conductive elements provide effective fastening of the conductive element, without requiring welding, and while allowing a substantial passage of current in the conductive element.

Advantageously, the invention applies to a heating device comprising an electrode device whereof the two terminals are arranged on a same side, unlike devices known from the state of the art in which the terminals are diametrically opposite, which has a greater bulk outside the pollution control housing. Such an electrode device whereof the two terminals are arranged on a same side is therefore more compact.

For example, the center distance between the terminals is less than 10 cm, preferably less than 5 cm, and still more preferably between 3 and 4 cm.

A heating device according to the invention may further include one or more of the following characteristics, considered alone or according to all technically possible combinations:

The device includes at least two conductive elements, preferably arranged in parallel with one another.

At least one of the conductive elements has its first end connected to the first terminal and its second end connected to the second terminal, such that a first electric current circulates in this conductive element, in a first circulation direction, and at least one other of the conductive elements has its first end connected to the second terminal and its second end connected to the first terminal, such that the second electric current circulates in this conductive element in a second circulation direction opposite the first direction.

The heating device includes a holder to keep conductive elements in contact on the connecting pieces.

Each third part of each connecting piece is arranged, in the longitudinal direction, either between the second part and a third part adjacent to this second part of the other connecting piece, or between two adjacent third parts of the other connecting piece.

Layers of electrically insulating material are inserted between the connecting pieces, each layer of insulating material being inserted between the respective one of the third parts of one of the connecting pieces and the second part of the other connecting piece, or between the respective one of the third parts of one of the connecting pieces and the respective one of the third parts of the other connecting piece.

Each end of each conductive element is fastened to the respective one of the second or third parts of the respective one of the connecting pieces, between this second or third part and the layer of material insulating this second or third part.

The insulating material is mica.

The heating device includes a plurality of conductive elements all extending in a same plane, without contact with or intersecting one another, such that for any pair of adjacent conductive elements from among said plurality of conductive elements, the first end of each conductive element of the pair is connected to the same terminal as the second end of the other conductive element of the pair.

The heating device includes a support frame delimiting a passage for the gases, and at least one conductive element extending between two ends and arranged in the passage, each conductive element being connected at each of its ends to a respective electrode, the device including at least one electrically insulating support plate for each conductive element, secured to the support frame.

Each support plate includes, for each conductive element, at least one respective passage slot for this conductive element, each passage slot extending between an open end and a closed end, and comprising a shoulder between the open and closed ends, the conductive element being arranged between the closed end and the shoulder.

The heating device includes a plurality of support plates, including:—a first central plate, secured to the support frame,—at least one second plate, extending between a first end connected to the support frame, and a second end provided with a slot engaged on the first central plate.

The heating device includes at least one pair of second plates, preferably two pairs of second plates, the second plates of a same pair intertwining at their second ends at the central plate.

Each support plate is connected to the support frame, by inserting at least one end of this support plate into a slot arranged to that end in the support frame.

Each support plate is made from an electrically insulating material withstanding temperatures above 500° C., for example from mica.

The support frame has an inner surface delimiting said passage, and an outer surface, the outer surface being provided with at least one shimming element, intended to be inserted between the support frame and an inner wall of an exhaust line housing.

The support frame is formed by the housing.

b. The invention also relates to an exhaust line, in particular for an automobile, that includes an exhaust gas heating device as previously defined.

BRIEF DESCRIPTION OF THE DRAWINGS

The invention will be better understood upon reading the following description, provided solely as an example and done in reference to the appended figures, in which.

DETAILED DESCRIPTION

Figure 1:
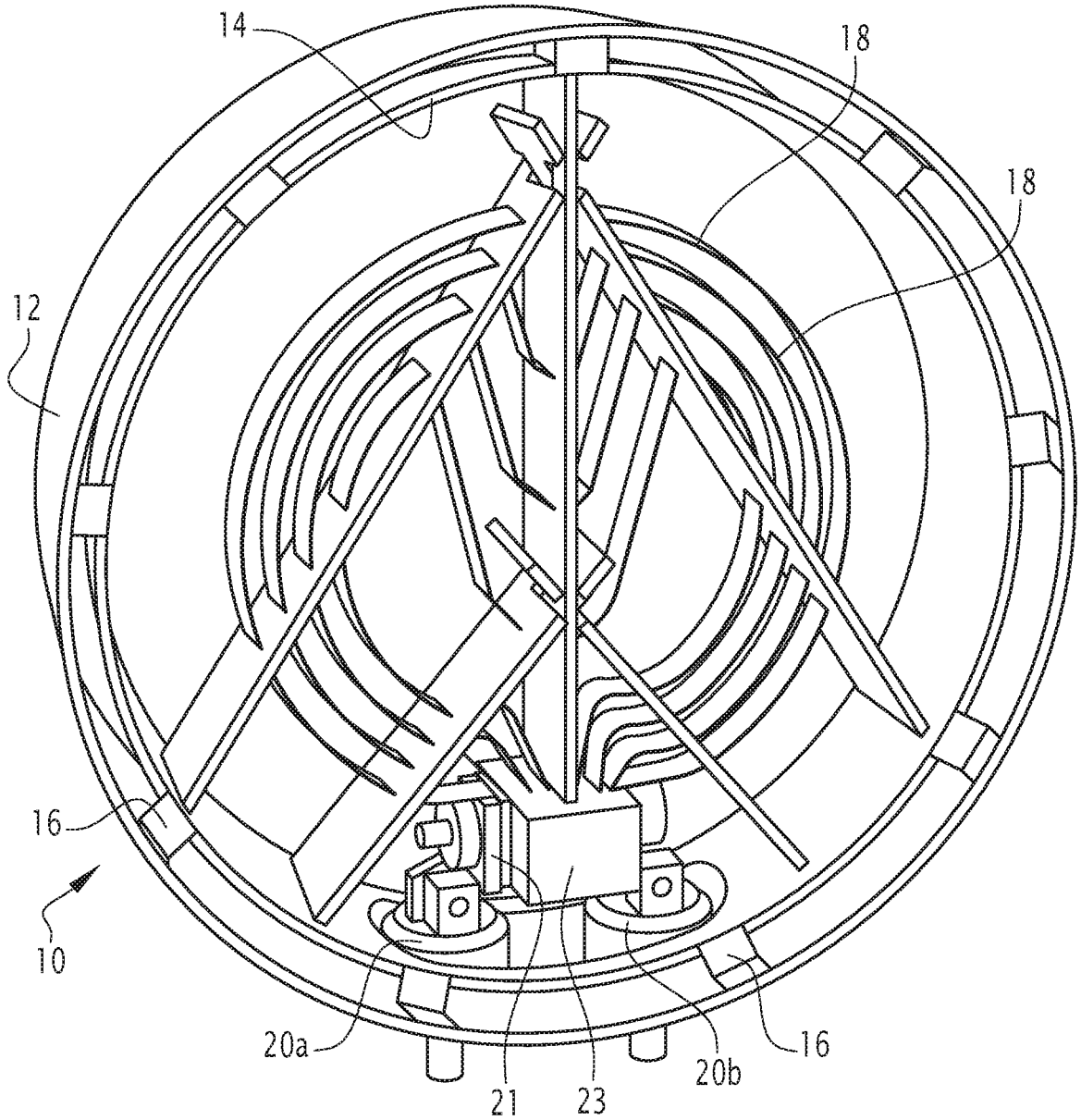
FIG. 1 is a perspective view of a heating device according to one example of the invention.

FIG. 1 shows an exhaust gas heating device 10 according to one exemplary embodiment of the invention. The heating device 10 is arranged in an exhaust line housing 12, through which the exhaust gases are intended to circulate, near a catalyst.

The housing 12, for example, has a generally cylindrical shape with a circular base.

The heating device 10 includes a support frame 14 delimiting a passage for the exhaust gases. The support frame 14, for example, has a generally cylindrical shape with a circular base, preferably coaxial with respect to the housing 12.

a. The support frame 14 has a lower surface delimiting said passage and an outer surface facing the housing 12. The outer surface is provided with a plurality of shimming elements 16 intended to be inserted between the support frame 14 and an inner wall of the exhaust line housing 12. The shimming elements 16 therefore define a circular space between the support frame 14 and the housing 12.

b. The shimming elements 16 are fastened to the support frame 14 on the one hand, and the housing 12 on the other hand, for example by welding.

The heating device 10 further includes at least one conductive element 18 extending, in a predetermined direction, between first and second ends, and arranged in the passage. It should be noted that the predetermined direction is the same for all of the conductive elements.

Advantageously, the heating device 10 includes a plurality of conductive elements 18 all extending in a same plane, without contact with or intersecting one another.

In the described example, the heating device 10 includes four conductive elements 18 arranged in parallel. Considering a median plane of the heating device 10, each conductive element 18 has its ends on either side of this median plane.

The heating device 10 includes two electrodes, one forming a negative terminal 20*a* and the other forming a positive terminal 20*b*. Each end of each conductive element 18 is connected to a respective one of the electrodes 20*a*, 20*b*.

Each conductive element 18 is fastened to the electrodes 20*a*, with a first 21 and second 23 connecting piece.

An electric current is therefore able to circulate in the conductive element 18, which results in increasing its temperature by Joule effect. This makes it possible to heat the exhaust gases passing in the heating device 10.

a. Advantageously, at least one of the conductive elements 18, preferably each conductive element 18, includes two curved lateral parts, for example in an arc of circle, and one central part comprising two substantially straight portions, each extending one of the lateral parts, and converging toward one another. This shape makes it possible to increase the length of the conductive element 18 relative to a circular conductive element.

For example, at least one of the conductive elements 18, preferably each conductive element 18, has a length greater than 500 mm, preferably greater than 1000 mm Indeed, the efficiency of the conductive elements 18 increases with their length, the exchange surface between the exhaust gases and the conductive elements 18 increasing with this length.

According to the described example, at least one of the conductive elements 18, preferably each conductive element 18, is formed by a strip, having a width smaller than its length, and a thickness much smaller than its width.

a. For example, the width of at least one of the conductive elements 18, preferably of each conductive element 18, is smaller than 10 mm, preferably approximately equal to 5 mm Indeed, the efficiency of the conductive elements 18 increases with their width, the exchange surface between the exhaust gases and the conductive elements 18 increasing with this width.

b. For example, the thickness of at least one of the conductive elements 18, preferably of each conductive element 18, is smaller than 0.2 mm, preferably approximately equal to 0.1 mm. This small thickness makes it possible to increase the reaction time of the device.

c. The dimensions defined above make it possible to optimize the efficiency of the conductive elements for a given electrical energy.

d. It will be noted that the conductive elements 18 are, for example, made from Nickel-Chromium (NiCr), Iron-Chromium-Aluminum (FeCrAl) or a stainless steel alloy to increase their lifetime.

Figure 2:
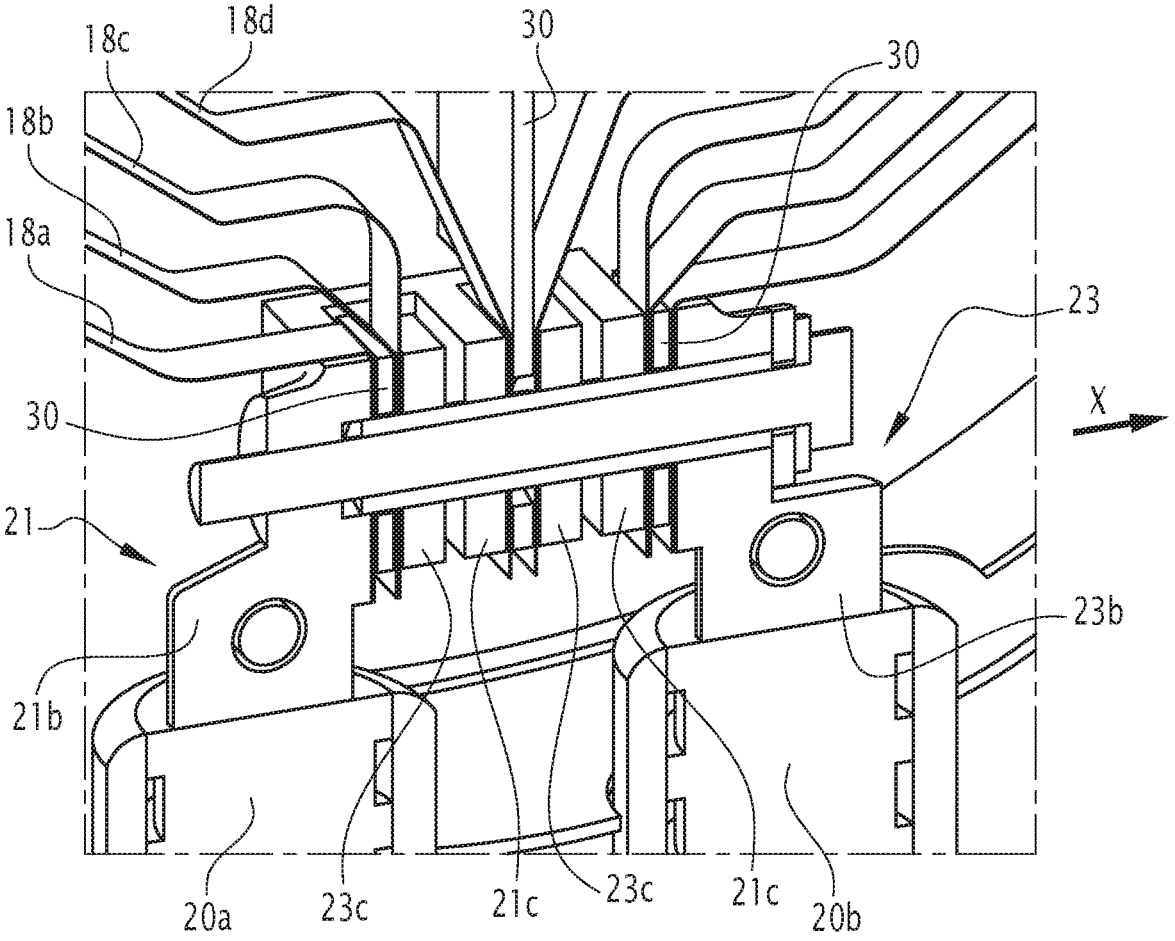
FIG. 2 is a cross-sectional view of a detail of the heating device of FIG. 1, along a first section plane.
Figure 3:
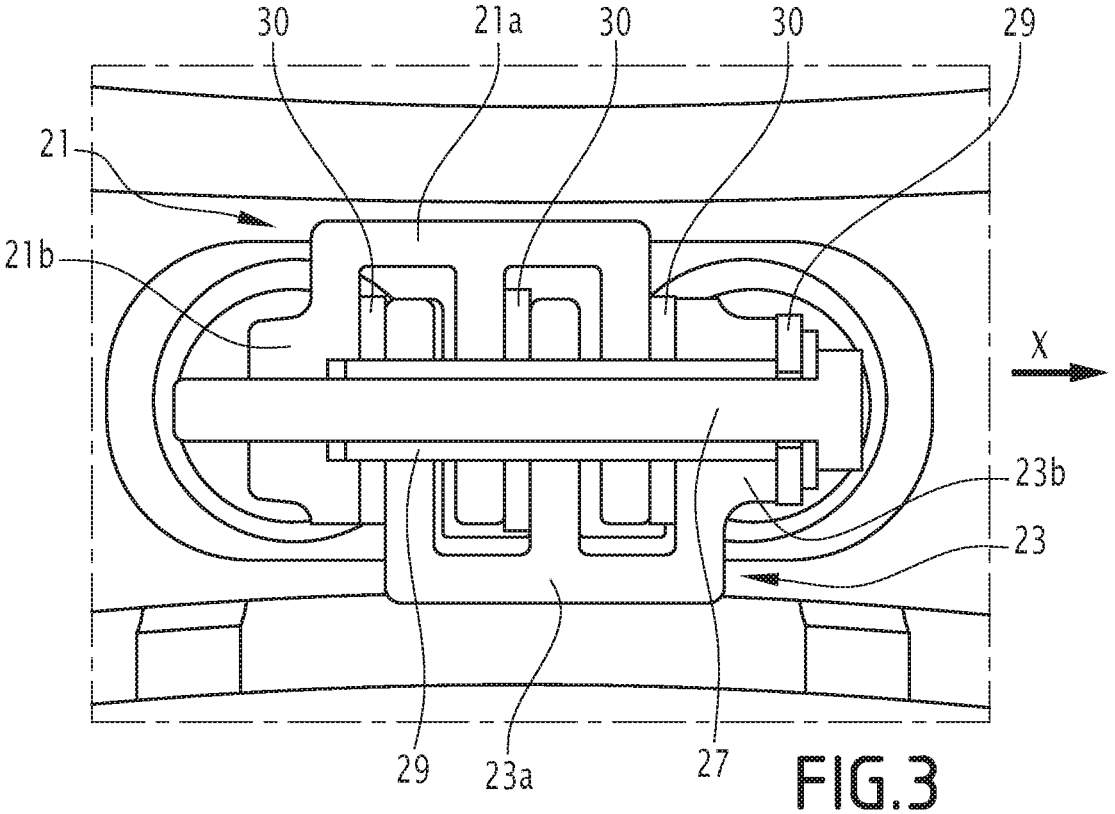
FIG. 3 is a cross-sectional view of the detail of FIG. 2, along a second section plane perpendicular to the first section plane.

The first and second connecting parts 21, 23 are described in more detail in light of FIGS. 2 and 3.

The first 21 and second 23 connecting parts are made from electrically conductive material. Each connecting part includes:

a first part 21*a*, 23*a* that is a substantially planar longitudinal part extending in a longitudinal direction X, a second connecting part 21*b*, 23*b*, connected to the first part 21*a*, 23*a* while extending transversely to this first part, the second connecting part 21*b*, 23*b* being connected to a respective one of the negative and positive terminals 20*a*, 20*b*, and at least one third part 21*c*, 23*c*, connected to the first part 21*a*, 23*a* while extending transversely to this first part 21*a*, 23*a*.

b. In the described example, the first 21*a*, 23*a*, second 21*b*, 23*b* and third 21*c*, 23*c* parts of each connecting piece 21, 23 come from a single integral piece.

c. In another example, at least one of the connecting pieces 21, 23 is integral with the corresponding terminal 20*a*, 20*b*. More specifically, the first connecting piece 21 is integral with the first terminal 20*a* and/or the second connecting piece 23 is integral with the second terminal 20*b*.

d. In the described example, each connecting piece 21, 23 includes two third parts 21*c*, 23*c*, but in a variant, they could include a single one or more than two.

e. The connecting parts 21, 23 are engaged in one another, such that each third part 21*c*, 23*c* of each connecting piece 21, 23 is inserted, in the longitudinal direction X, between the second part and the third part adjacent to this second part of the other connecting piece, or between two adjacent third parts of the other connecting piece.

Figure 4:
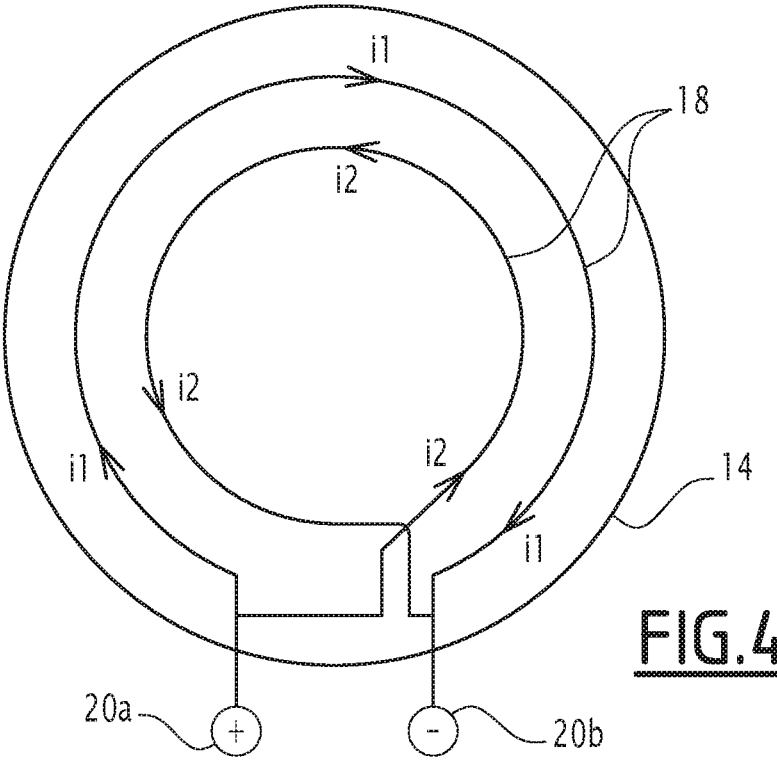
FIG. 4 schematically shows the circulation of current in two conductive elements of the heating device of FIG. 1.

Each conductive element 18 has one of its ends connected to the second 21*b*, 23*b* or third part 21*c*, 23*c* of one of the connecting pieces, and the other of its ends connected to the second 21*b*, 23*b* or third part 21*c*, 23*c* of the other connecting piece.

a. More particularly, as shown in FIG. 4, at least one of the conductive elements 18 has its first end connected to the terminal connecting piece 21 and its second end connected to the second connecting piece 23, such that a first electric current i1 circulates in this conductive element 18, in a first circulation direction, and at least one other of the conductive elements 18 has its first end connected to the second connecting piece 23 and its second end connected to the first connecting piece 21, such that the second electric current i2 circulates in this conductive element in a second circulation direction opposite the first direction.

b. The currents i1 and i2 being opposite, the magnetic fields that they induce by circulating in the corresponding conductive elements 18 also oppose one another. As a result, the overall magnetic field induced by the heating device 10 is weak.

c. To that end, an even number of conductive elements 18 will be provided, the number of conductive elements 18 in which the first electric current i1 circulates in the first direction being equal to the number of conductive elements 18 in which the second electric current i2 circulates in the second direction.

d. Advantageously, for any pair of adjacent conductive elements from among said plurality of conductive elements, the first end of each conductive element of the pair is connected to the same terminal as the second end of the other conductive element of the pair.

e. For example, in the case, shown in the figures, where the heating device 10 includes four conductive elements 18, called first 18*a*, second 18*b*, third 18*c* and fourth 18*d* conductive elements, then:

the first outer conductive element 18*a* surrounds all of the other conductive elements 18*b*, 18*c*, 18*d*, the second conductive element 18*b* surrounds the third 18*c* and fourth 18*d* conductive elements, the third conductive element 18*c* surrounds the fourth conductive element 18*d*, the first ends of the first 18*a* and fourth 18*d* conductive elements are connected to the first positive terminal 20*a* and their second ends are connected to the second negative terminal 20*b*, and the first ends of the second 18*b* and third 18*c* conductive elements are connected to the second negative terminal 20*b* and their second ends are connected to the first positive terminal 20*a*.

f. Thus, the current circulates in the first direction in the first 18*a* and fourth 18*d* conductive elements, and in the second direction in the second 18*b* and third 18*c* conductive elements.

g. Advantageously, the heating device 10 includes a holder 27 for keeping ends of each conductive element 18 in contact with the connecting pieces 21, 23.

h. In the described example, the holder comprises a stud 27 passing through the ends of the conductive elements 18 and the second 21*b*, 23*b* and third 21*c*, 23*c* parts of the connecting pieces 21, 23. This through stud 27 is at least partially covered by an insulating material 29, so as not to conduct the current between the first 21 and second 23 connecting pieces. The insulating material 29 is, for example, mica.

i. In a variant, the holder 27 includes a seal clamp.

j. In other variants, the holder 27 can be formed by any type of fastening, for example welding, riveting, gluing, etc.

k. Furthermore, layers of electrically insulating material 30 are inserted between the connecting pieces 21, 23, each layer of insulating material 30 being inserted between the respective one of the third parts 21*c*, 23*c* of one of the connecting pieces 21, 23 and the second part 21*b*, 23*b* of the other connecting piece 21, 23, or between the respective one of the third parts 21*c*, 23*c* of one of the connecting pieces and the respective one of the third parts 21*c*, 23*c* of the other connecting piece.

l. Optionally, the electrically insulating material 30, inserted between the connecting parts 21, 23, also forms a support structure for the conductive elements 18 in the gas passage.

m. Advantageously, each layer of material 30 is made from mica.

n. Each end of each conductive element 18 is fastened to the respective one of the second 21*b*, 23*b* or third 21*c*, 23*c* parts of the respective one of the connecting pieces, between this second 21*b*, 23*b* or third 21*c*, 23*c* part and the layer of material 30 insulating this second or third part.

o. More specifically, in the described example:

the first end of the first conductive strip 18*a* is connected to the second part 21*b* of the first connecting piece 21, and the second end of the first conductive strip 18*a* is connected to the second part 23*b* of the second connecting piece 23, the first end of the second conductive strip 18*b* is connected to one of the third parts 21*c* of the first connecting piece 21, and its second end is connected to one of the third parts 23*c* of the second connecting piece 23, the first end of the third conductive strip 18*c* is connected to one of the third parts 21*c* of the first connecting piece 21, and its second end is connected to one of the third parts 23*c* of the second connecting piece 23, the first end of the fourth conductive strip 18*d* is connected to one of the third parts 23*c* of the second connecting piece 23, and its second end is connected to one of the third parts 21*c* of the first connecting piece 21.

Advantageously, each conductive element end 18 is maintained by the holder 27, for example by clamping, each from among one of the second or third parts of the corresponding connecting piece and one of the insulating layers 30.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. An exhaust gas heating device, including:

at least one conductive element intended to be arranged in an exhaust gas passage, and designed to heat exhaust gases circulating in the exhaust gas passage, each conductive element extending in a shared predefined direction between a first and a second end, and a first positive electric terminal and a second negative electric terminal, wherein the exhaust gas heating device includes first and second connecting pieces made from a conductive material, each of the first and second connecting pieces being distinct from each conductive element, and each first and second connecting piece including:

a first substantially planar longitudinal conductive part extending in a longitudinal direction, a second conductive connecting part, connected to the first substantially planar longitudinal conductive part and extending parallel to a transverse direction perpendicular to the longitudinal direction, the second conductive connecting part being connected to a respective one of the first positive and second negative electric terminals, and at least one third conductive part, connected to the first substantially planar longitudinal conductive part and extending parallel to the transverse direction perpendicular to the longitudinal direction, each conductive element having one of the first and second ends electrically connected to a part of one of the first and second connecting pieces chosen between the second conductive connecting part or third conductive part of said one of the first and second connecting pieces, and the other of the first and second ends electrically connected to a part of the other of the first and second connecting pieces chosen between the second conductive connecting part or third conductive part of said other of the first and second connecting pieces.

2. The exhaust gas heating device according to claim 1, including at least two conductive elements arranged in parallel with one another.

3. The exhaust gas heating device according to claim 1, including at least two conductive elements, and wherein:

at least one of the conductive elements has the first end connected to the first positive electric terminal and the second end connected to the second negative electric terminal, such that a first electric current circulates in the one of the conductive elements, in a first circulation direction, at least one other of the conductive elements has the first end connected to the second negative electric terminal and the second end connected to the first positive electric terminal, such that a second electric current circulates in the other of the conductive elements in a second circulation direction opposite the first circulation direction.

4. The exhaust gas heating device according to claim 1, including a holder to keep conductive elements in contact on the first and second connecting pieces.

5. An exhaust gas heating device, including:

at least one conductive element intended to be arranged in an exhaust gas passage, and designed to heat exhaust gases circulating in the exhaust gas passage, each conductive element extending in a shared predefined direction between a first and a second end, and a first positive electric terminal and a second negative electric terminal, wherein the exhaust gas heating device includes first and second connecting pieces made from a conductive material, such that each first and second connecting piece includes:

a first part that is a substantially planar longitudinal part extending in a longitudinal direction, a second part, connected to the first part while extending transversely to the first part, the second part being connected to a respective one of the first positive and second negative electric terminals, and at least one third part, connected to the first part and extending parallel to a transverse direction perpendicular to the longitudinal direction, each conductive element having one of the first and second ends connected to a part of one of the first and second connecting pieces chosen between the second or third part of said one of the first and second connecting pieces, and the other of the first and second ends connected to a part of the other of the first and second connecting pieces chosen between the second or third part of said other of the first and second connecting pieces, wherein each third part of each first and second connecting piece is arranged, in the longitudinal direction, either between two adjacent parts of the other first and second connecting piece, chosen between the second part and a third part adjacent to this second part of the other first and second connecting piece, or two adjacent third parts of the other first and second connecting piece.

6. The exhaust gas heating device according to claim 5, wherein layers of electrically insulating material are inserted between the first and second connecting pieces, each layer of insulating material being inserted between the respective one of the third parts of one of the first and second connecting pieces and the second part of the other first and second connecting piece, or between the respective one of the third parts of one of the first and second connecting pieces and the respective one of the third parts of the other first and second connecting piece.

7. The exhaust gas heating device according to claim 6, wherein each end of each conductive element is fastened to the respective one of the second or third parts of the respective one of the first and second connecting pieces, between this second or third art and the layer of electrically insulating material that insulates this second or third part.

8. The exhaust gas heating device according to claim 6, wherein the electrically insulating material is mica.

9. The exhaust gas heating device according to claim 1, wherein the at least one conductive element comprises a plurality of conductive elements all extending in a same plane, without contact with or intersecting one another, such that for any pair of adjacent conductive elements from among said plurality of conductive elements, the first end of each conductive element of the pair is connected to a same terminal of the first positive and the second negative electric terminal as the second end of the other conductive element of the pair.

10. An exhaust line, in particular for an automobile, including an exhaust gas heating device including:

at least one conductive element intended to be arranged in an exhaust gas passage, and designed to heat exhaust gases circulating in the exhaust gas passage, each conductive element extending in a shared predefined direction between a first and a second end, and a first positive electric terminal and a second negative electric terminal, the exhaust gas heating device including first and second connecting pieces made from a conductive material, each of the first and second connecting pieces being distinct from each conductive element, and each first and second connecting piece including:

a first substantially planar longitudinal conductive part extending in a longitudinal direction, a second conductive connecting part connected to the first substantially planar longitudinal conductive part and extending parallel to a transverse direction perpendicular to the longitudinal direction, the second conductive part being connected to a respective one of the first positive and second negative electric terminals, and at least one third conductive part, connected to the first substantially planar longitudinal conductive part and extending parallel to the transverse direction perpendicular to the longitudinal direction, each conductive element having one of the first and second ends electrically connected to the second conductive connecting part or third conductive part of one of the first and second connecting pieces, and the other of the first and second ends electrically connected to the second conductive connecting part or third conductive part of the other of the first and second connecting pieces.

* * * * *